US007111692B2

(12) United States Patent
Hosie et al.

(10) Patent No.: US 7,111,692 B2
(45) Date of Patent: Sep. 26, 2006

(54) APPARATUS AND METHOD TO REDUCE FLUID PRESSURE IN A WELLBORE

(75) Inventors: David Hosie, Sugar Land, TX (US); R. K. Bansal, Houston, TX (US); Peter B. Moyes, Aberdeen (GB)

(73) Assignee: Weatherford/Lamb, Inc, Houston, TX (US)

( * ) Notice: Subject to any disclaimer, the term of this patent is extended or adjusted under 35 U.S.C. 154(b) by 0 days.

(21) Appl. No.: 10/958,734

(22) Filed: Oct. 5, 2004

(65) Prior Publication Data

US 2005/0045382 A1 Mar. 3, 2005

Related U.S. Application Data

(60) Division of application No. 10/156,722, filed on May 28, 2002, now Pat. No. 6,837,313, which is a continuation-in-part of application No. 09/914,338, filed as application No. PCT/GB00/00642 on Feb. 25, 2000, now Pat. No. 6,719,071.

(30) Foreign Application Priority Data

Feb. 25, 1999 (GB) ..... 9904380.4

(51) Int. Cl.
*E21B 7/18* (2006.01)

(52) U.S. Cl. ..... 175/25; 175/214

(58) Field of Classification Search ..... 175/25, 175/48, 65, 57, 214, 217
See application file for complete search history.

(56) References Cited

U.S. PATENT DOCUMENTS

| | | | | |
|---|---|---|---|---|
| 1,892,217 | A | 12/1932 | Moineau | |
| 2,894,585 | A * | 7/1959 | Erwin | 166/301 |
| 3,583,500 | A | 6/1971 | Randall et al. | |
| 4,049,066 | A | 9/1977 | Richey | |
| 4,063,602 | A | 12/1977 | Howell et al. | |
| 4,291,772 | A | 9/1981 | Beynet | |
| 4,368,787 | A * | 1/1983 | Messenger | 175/319 |
| 4,430,892 | A | 2/1984 | Owings | |
| 4,479,558 | A * | 10/1984 | Gill et al. | 175/320 |
| 4,534,426 | A | 8/1985 | Hooper | |
| 4,583,603 | A | 4/1986 | Dorleans et al. | |
| 4,630,691 | A * | 12/1986 | Hooper | 175/65 |
| 4,744,426 | A | 5/1988 | Reed | |
| 4,813,495 | A | 3/1989 | Leach | |
| 5,339,899 | A | 8/1994 | Ravi et al. | |

(Continued)

FOREIGN PATENT DOCUMENTS

| | | |
|---|---|---|
| WO | WO 00/04269 | 1/2000 |

(Continued)

OTHER PUBLICATIONS

PCT International Search Report, International Application No. PCT/US/16686, dated Aug. 21, 2003.

(Continued)

*Primary Examiner*—Frank S. Tsay
(74) *Attorney, Agent, or Firm*—Patterson & Sheridan, L.L.P.

(57) ABSTRACT

The present invention generally provides apparatus and methods for reducing the pressure of a circulating fluid in a wellbore. In one aspect of the invention an ECD (equivalent circulation density) reduction tool provides a means for drilling extended reach deep (ERD) wells with heavyweight drilling fluids by minimizing the effect of friction head on bottomhole pressure so that circulating density of the fluid is close to its actual density. With an ECD reduction tool located in the upper section of the well, the friction head is substantially reduced, which substantially reduces chances of fracturing a formation.

11 Claims, 6 Drawing Sheets

U.S. PATENT DOCUMENTS

| | | | |
|---|---|---|---|
| 5,355,967 | A | 10/1994 | Mueller et al. |
| 5,651,420 | A | 7/1997 | Tibbitts et al. |
| 5,720,356 | A | 2/1998 | Gardes |
| 5,842,149 | A | 11/1998 | Harrell et al. |
| 6,065,550 | A | 5/2000 | Gardes |
| 6,138,774 | A | 10/2000 | Bourgoyne, Jr. et al. |
| 6,257,333 | B1 | 7/2001 | Mann et al. |
| 6,374,925 | B1 | 4/2002 | Elkins et al. |
| 6,719,071 | B1 | 4/2004 | Moyes |
| 6,837,313 | B1 | 1/2005 | Hosie et al. |
| 2004/0188145 | A1 | 9/2004 | Moyes |

FOREIGN PATENT DOCUMENTS

| | | |
|---|---|---|
| WO | WO 00/08293 | 2/2000 |
| WO | WO 00/50731 | 8/2000 |
| WO | WO 02/14649 | 2/2002 |
| WO | WO 03/023182 | 3/2003 |
| WO | WO 03/025336 | 3/2003 |

OTHER PUBLICATIONS

Forrest, et al., "Subsea Equipment for Deep Water Drilling Using Dual Gradient Mud System," SPE/IADC Drilling Conference, Amsterdam, The Netherlands, Feb. 27, 2001-Mar. 1, 2001, 8 Pages.

International Search Report, International Application No. PCT/GB 00/00642, dated Jun. 19, 2000. (WO 00/50731—MRKS/0045).

* cited by examiner

APPARATUS AND METHOD TO REDUCE FLUID PRESSURE IN A WELLBORE

This application is a divisional of U.S. patent application Ser. No. 10/156,722 filed May 28, 2002 now U.S. Pat. No. 6,837,313. U.S. patent application Ser. No. 10/156,722 is a continuation-in-part of U.S. patent application Ser. No. 09/914,338, filed on Jan. 8, 2002 now U.S. Pat. No. 6,719,071, which is the National Stage of International Application No. PCT/GB00/00642, filed on Feb. 25, 2000, which claims priority to Great Britain Patent Application No. 9904380.4, filed on Feb. 25, 1999. All of the above references are herein incorporated by reference in their entirety.

BACKGROUND OF THE INVENTION

1. Field of the Invention

The present invention relates to reducing pressure of a circulating fluid in a wellbore. More particularly, the invention relates to reducing the pressure brought about by friction as the fluid moves in a wellbore. More particularly still, the invention relates to controlling and reducing downhole pressure of circulating fluid in a wellbore to prevent formation damage and loss of fluid to a formation.

2. Description of the Related Art

Wellbores are typically filled with fluid during drilling in order to prevent the in-flow of production fluid into the wellbore, cool a rotating bit, and provide a path to the surface for wellbore cuttings. As the depth of a wellbore increases, fluid pressure in the wellbore correspondingly increases developing a hydrostatic head which is affected by the weight of the fluid in the wellbore. The frictional forces brought about by the circulation of fluid between the top and bottom of the wellbore create additional pressure known as a "friction head." Friction head increases as the viscosity of the fluid increases. The total effect is known as an equivalent circulation density (ECD) of the wellbore fluid.

In order to keep the well under control, fluid pressure in a wellbore is intentionally maintained at a level above pore pressure of formations surrounding the wellbore. Pore pressure refers to natural pressure of a formation urging fluid into a wellbore. While fluid pressure in the wellbore must be kept above pore pressure, it must also be kept below the fracture pressure of the formation to prevent the wellbore fluid from fracturing and entering the formation. Excessive fluid pressure in the wellbore can result in damage to a formation and loss of expensive drilling fluid.

Conventionally, a section of wellbore is drilled to that depth where the combination of the hydrostatic and friction heads approach the fracture pressure of the formations adjacent the wellbore. At that point, a string of casing must be installed in the wellbore to isolate the formation from the increasing pressure before the wellbore can be drilled to a greater depth. In the past, the total well depth was relatively shallow and casing strings of a decreasing diameter were not a big concern. Presently, however, so many casing strings are necessary in extended reach deep (ERD) wellbores that the path for hydrocarbons at a lower portion of the wellbore becomes very restricted. In some instances, deep wellbores are impossible to drill due to the number casing of strings necessary to complete the well. FIG. 5A illustrates this point, which is based on a deepwater Gulf of Mexico (GOM) example.

In FIG. 5A, dotted line A shows pore pressure gradient and line B shows fracture gradient of the formation, which is approximately parallel to the pore pressure gradient but higher. Circulating pressure gradients of 15.2-ppg (pounds per gallon) drilling fluid in a deepwater well is shown as line C. Since friction head is a function of distance traveled by the fluid, the circulation density line C is not parallel to the hydrostatic gradient of the fluid (line D). Safe drilling procedure requires circulating pressure gradient (line C) to lie between pore pressure and fracture pressure gradients (lines A and B). However, as shown in FIG. 5A, circulating pressure gradient of 15.2-ppg drilling fluid (line C) in this example extends above the fracture gradient curve at some point where fracturing of formation becomes inevitable. In order to avoid this problem, a casing must be set up to the depth where line C meets line B within predefined safety limit before proceeding with further drilling. For this reason, drilling program for GOM well called for as many as seven casing sizes, excluding the surface casing (Table 1).

TABLE 1

Planned casing program for GOM deepwater well.

| Casing size | Planned shoe depth | |
|---|---|---|
| (in.) | (TVD-ft) | (MD-ft) |
| 30 | 3,042 | 3,042 |
| 20 | 4,229 | 4,229 |
| 16 | 5,537 | 5,537 |
| 13-375 | 8,016 | 8,016 |
| 11⅜ | 13,622 | 13,690 |
| 9⅝ | 17,696 | 18,171 |
| 7 | 24,319 | 25,145 |
| 5 | 25,772 | 26,750 |

Another problem associated with deep wellbores is differential sticking of a work string the well. If wellbore fluid enters an adjacent formation, the work string can be pulled in the direction of the exiting fluid due to a pressure differential between pore and wellbore pressures, and become stuck. The problem of differential sticking is exacerbated in a deep wellbore having a work string of several thousand feet. Sediment buildup on the surface of the wellbore also causes a work string to get stuck when drilling fluid migrates into the formation.

The problem of circulation wellbore pressure is also an issue in under balanced wells. Underbalanced drilling relates to drilling of a wellbore in a state wherein fluid in the wellbore is kept at a pressure below the pore pressure of an adjacent formation. Underbalanced wells are typically controlled by some sort of seal at the surface rather than by heavy fluid in the wellbore. In these wells, it is necessary to keep any fluid in the wellbore at a pressure below pore pressure.

Various prior art apparatus and methods have been used in wellbores to effect the pressure of circulating fluids. For example, U.S. Pat. Nos. 5,720,356 and 6,065,550 provide a method of underbalanced drilling utilizing a second annulus between a coiled tubing string and a primary drill string. The second annulus is filled with a second fluid that commingles with a first fluid in the primary annulus. The fluids establish an equilibrium within the primary string. U.S. Pat. No. 4,063,602, related to offshore drilling, uses a valve at the bottom of a riser to redirect drilling fluid to the sea in order to influence the pressure of fluid in the annulus. An optional pump, located on the sea floor provides lift to fluid in the wellbore. U.S. Pat. No. 4,813,495 is a drilling method using a centrifugal pump at the ocean floor to return drilling fluid to the surface of the well, thereby permitting heavier fluids to be used. U.S. Pat. No. 4,630,691 utilizes a fluid bypass to reduce fluid pressure at a drill bit. U.S. Pat. No. 4,291,772 describes a sub sea drilling apparatus with a separate return fluid line to the surface in order to reduce weight or tension in a riser. U.S. Pat. No. 4,583,603 describes a drill pipe joint with a bypass for redirecting fluid from the drill string to an annulus in order to reduce fluid pressure in an area where fluid is lost into a formation. U.S. Pat. No. 4,049,066 describes an apparatus to reduce pressure near a drill bit that operates to facilitate drilling and to remove cuttings.

The above mentioned patents are directed either at reducing pressure at the bit to facilitate the movement of cuttings to the surface or they are designed to provide some alternate path for return fluid. None successfully provide methods and apparatus specifically to facilitate the drilling of wells by reducing the number of casing strings needed.

There is a need therefore, for an improved pressure reduction apparatus and methods for use in a circulating wellbore that can be used to effect a change in wellbore pressure. There is a further need for a pressure reduction apparatus tool and methods for keeping fluid pressure in a circulating wellbore under fracture pressure. There is yet a further need for a pressure reduction apparatus and methods permitting fluids with a relatively high viscosity to be used without exceeding formation fracture pressure.

There is yet a further need for an apparatus and methods to effect a reduction of pressure in an underbalanced wellbore while using a heavyweight drilling fluid. There is yet a further need for an apparatus and methods to reduce pressure of circulating fluid in a wellbore so that fewer casing stings are required to drill a deep wellbore. There is yet a further need for an apparatus and method to reduce or to prevent differential sticking of a work string in a wellbore as a result of fluid loss into the wellbore.

SUMMARY OF THE INVENTION

The present invention generally provides apparatus and methods for reducing the pressure of a circulating fluid in a wellbore.

In one aspect of the invention an ECD (equivalent circulation density) reduction tool provides a means for drilling extended reach deep (ERD) wells with heavyweight drilling fluids by minimizing the effect of friction head on bottomhole pressure so that circulating density of the fluid is close to its actual density. With an ECD reduction tool located in the upper section of the well, the friction head is substantially reduced, which substantially reduces chances of fracturing a formation (see also FIG. 2 later on).

In another aspect of the invention, the ECD reduction tool provides means to set a casing shoe deeper and thereby reduces the number of casing sizes required to complete the well. This is especially true where casing shoe depth is limited by a narrow margin between pore pressure and fracture pressure of the formation.

In another aspect, the invention provides means to use viscous drilling fluid to improve the movement of cuttings. By reducing the friction head associated with the circulating fluid, a higher viscosity fluid can be used to facilitate the movement of cuttings towards the surface of the well.

In a further aspect of the invention, the tool provides means for underbalanced or near-balanced drilling of ERD wells. ERD wells are conventionally drilled overbalanced with wellbore pressure being higher than pore pressure in order to maintain control of the well. Drilling fluid weight is selected to ensure that a hydraulic head is greater than pore pressure. An ECD reduction tool permits the use of lighter drilling fluid so that the well is underbalanced in static condition and underbalanced or nearly-underbalanced in flowing condition.

In yet a further aspect of the invention, the apparatus provides a method to improve the rate of penetration (ROP) and the formation of a wellbore. This advantage is derived from the fact that ECD reduction tool makes it feasible to drill ERD and high-pressure wells underbalanced.

In yet a further aspect, the invention provides a method to eliminate fluid loss into a formation during drilling. With an ECD tool, there is much better control of wellbore pressure and the well may be drilled underbalanced such that fluid can flow into the well rather than from the well into the formation.

In another aspect of the invention, an ECD reduction tool provides a method to eliminate formation damage. In a conventional drilling method, fluid from the wellbore has a tendency to migrate into the formation. As the fluid moves into the formation, fine particles and suspended additives from the drilling fluid fill the pore space in the formation in the vicinity of the well. The reduced porosity of the formation reduces well productivity. The ECD reduction tool avoids this problem since the well can be drilled underbalanced.

In another aspect, the ECD reduction tool provides a method to minimize differential sticking.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

For example, the apparatus may consist of a hydraulic motor, electric motor or any other form of power source to drive an axial flow pump. In yet another example, pressurized fluid pumped into the well from the surface may be used to power a downhole electric pump for the purpose of reducing and controlling bottom hole pressure in the well.

It is to be noted, however, that the appended drawings illustrate only typical embodiments of this invention and are therefore not to be considered limiting of its scope, for the invention may admit to other equally effective embodiments.

Figure 1:
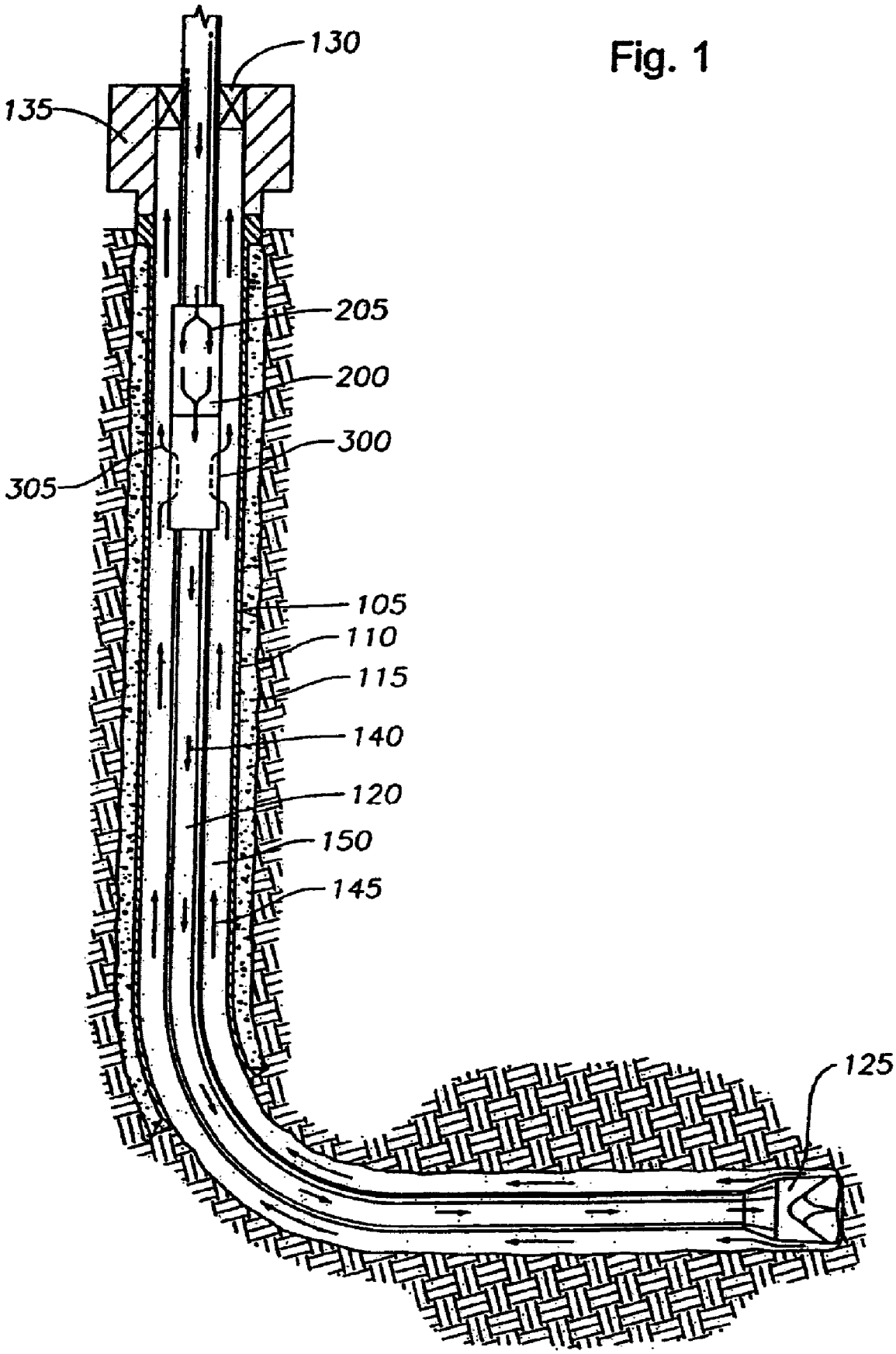

FIG. 1 is a section view of a wellbore having a work string coaxially disposed therein and a motor and pump disposed in the work string.

Figure 2A:
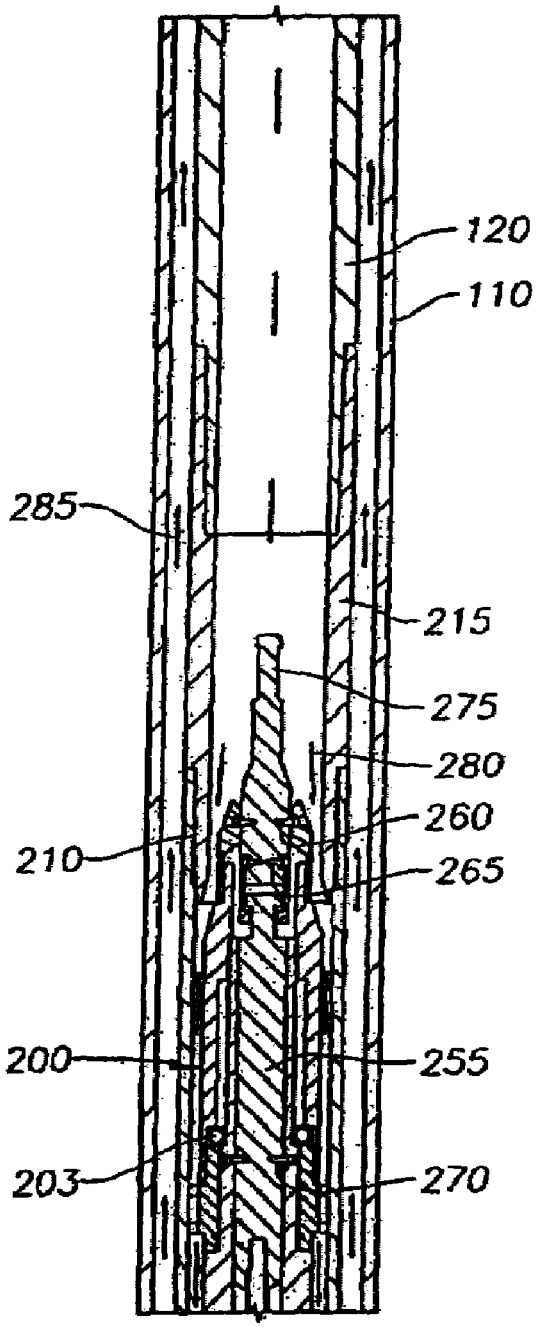

FIG. 2A is a section view of the wellbore showing an upper portion of the motor.

Figure 2B:
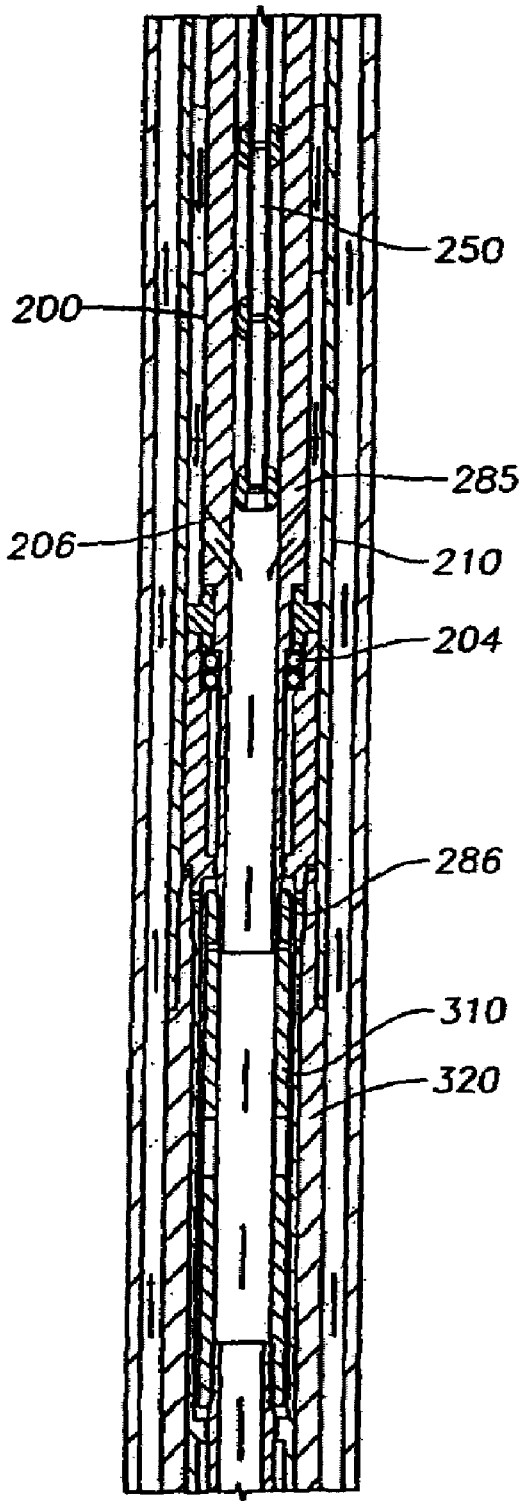

FIG. 2B is a section view showing the motor.

Figure 2C:
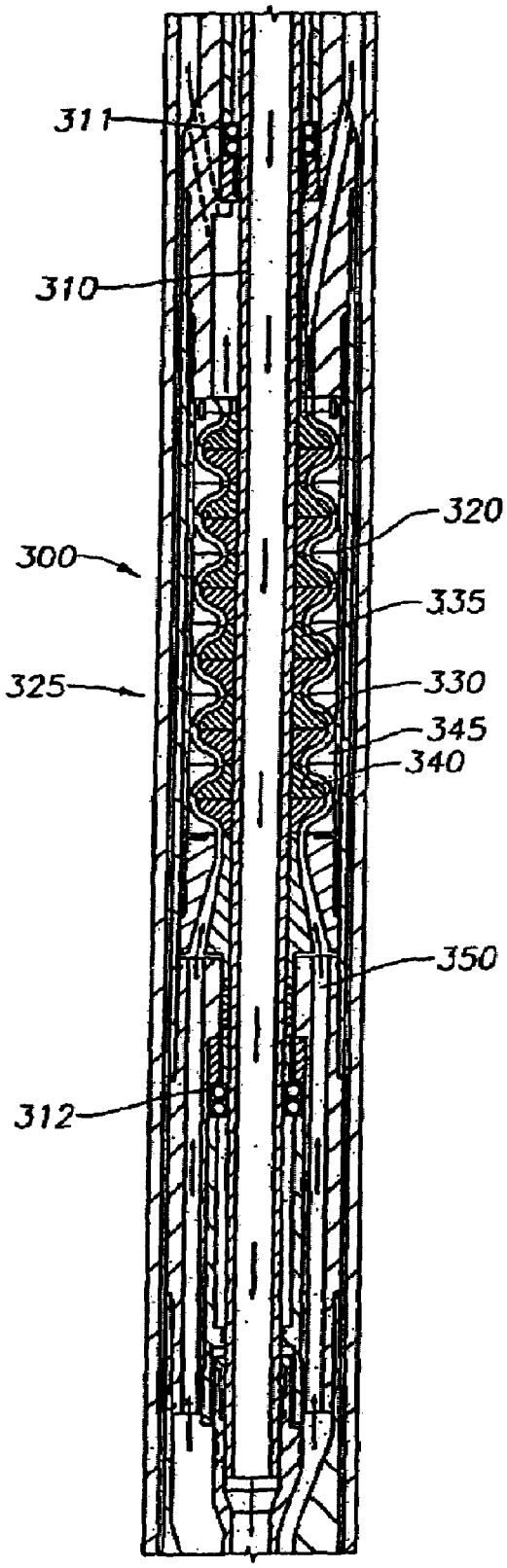

FIG. 2C is a section view of the wellbore and pump of the present invention.

Figure 2D:
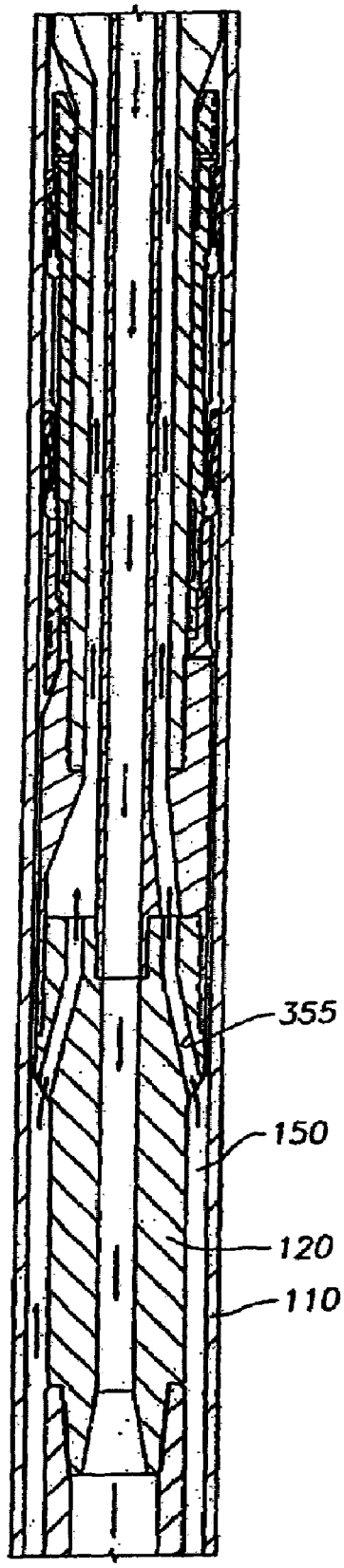

FIG. 2D is a section view of the wellbore showing an area of the wellbore below the pump.

Figure 3:
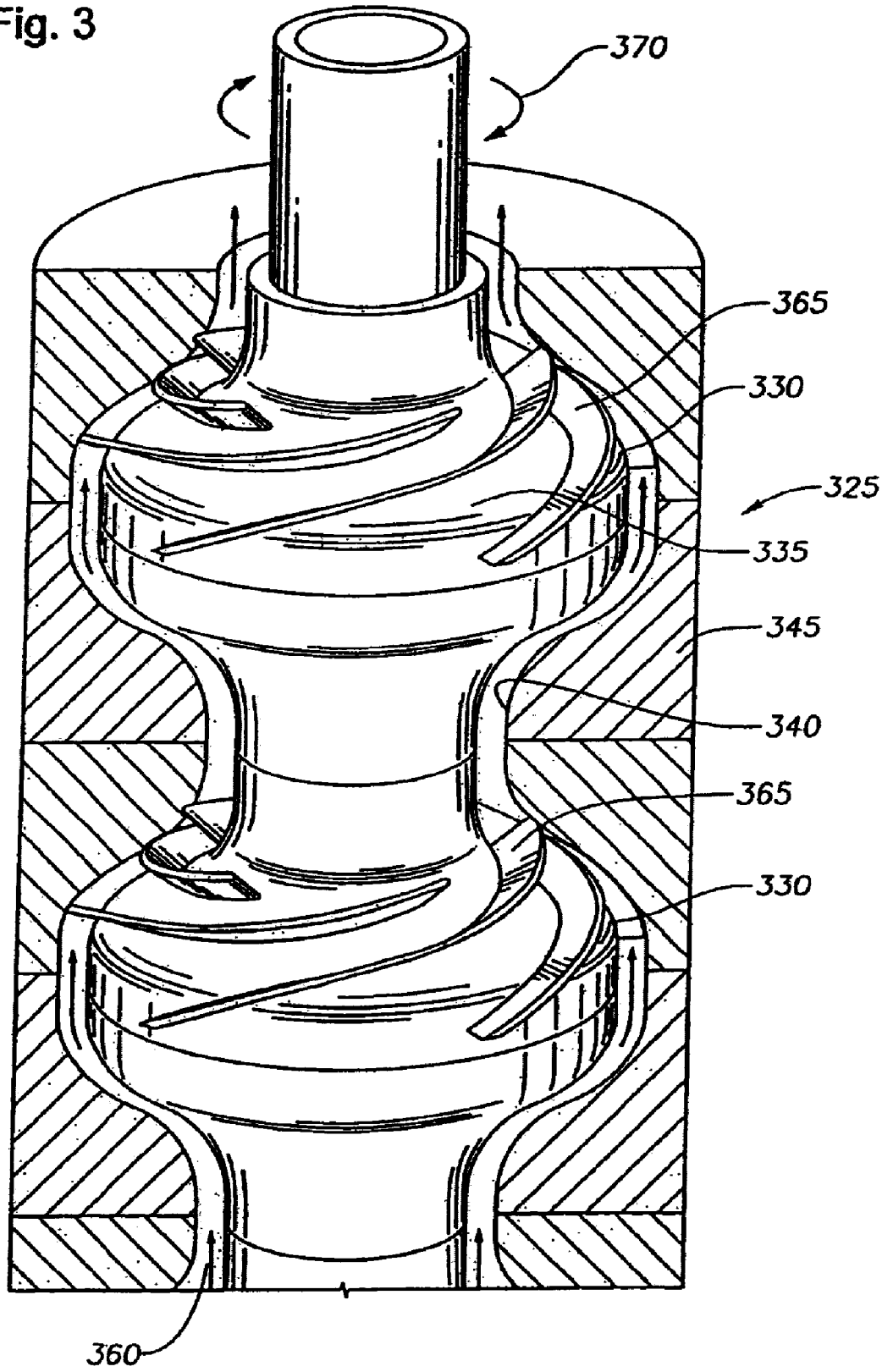

FIG. 3 is a partial perspective view of the impeller portion of the pump.

Figure 4:
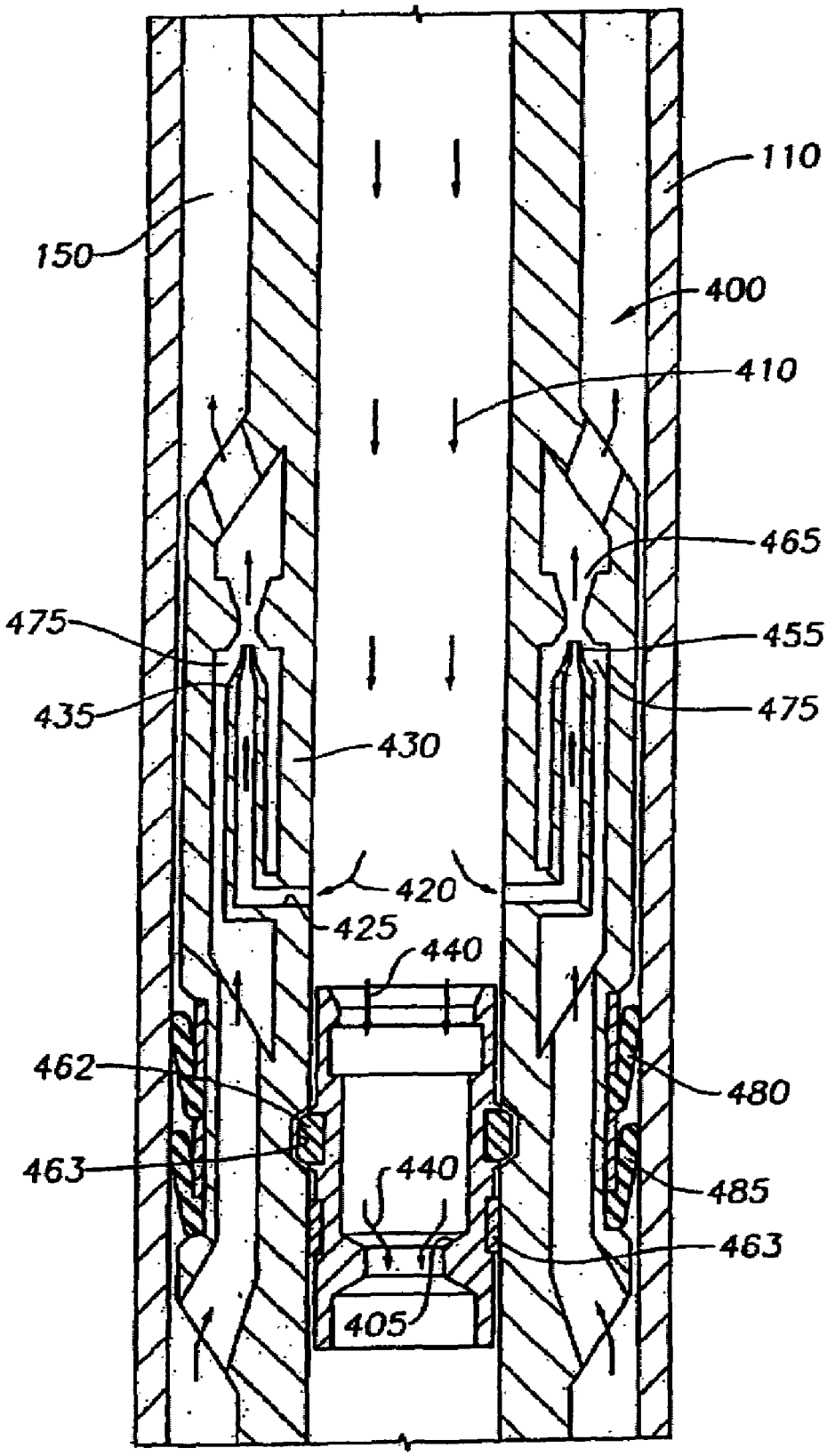

FIG. 4 is a section view of a wellbore showing an alternative embodiment of the invention.

Figure 5A:
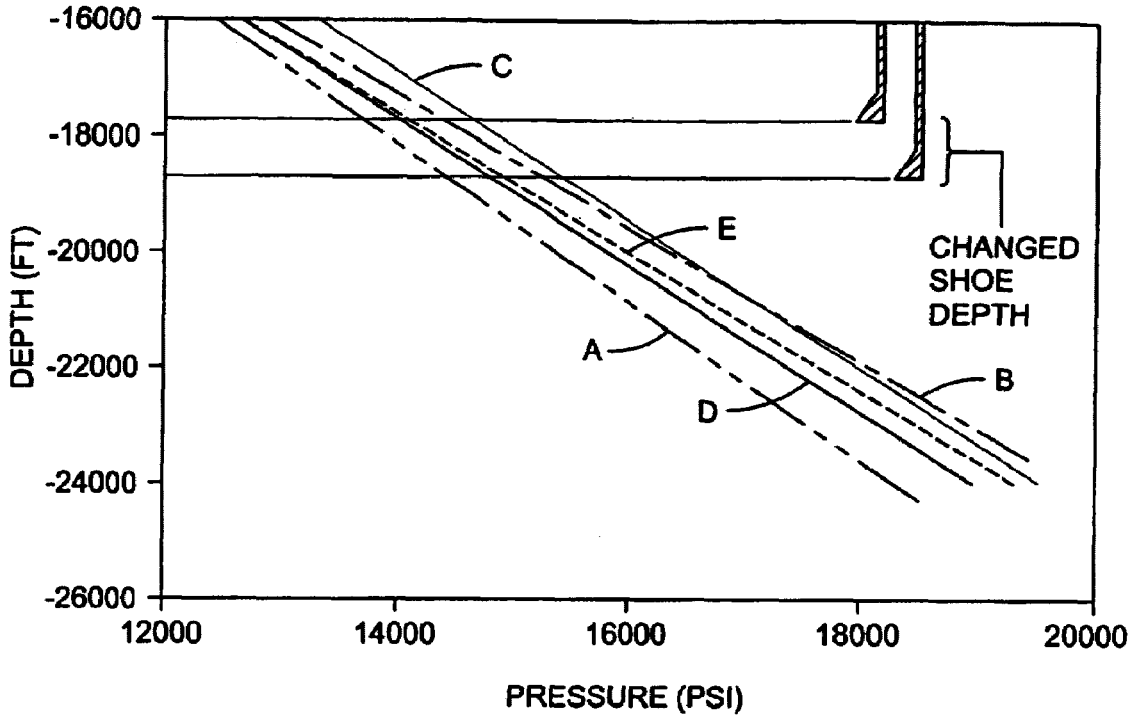

FIG. 5A is the effect of ECD on casing shoe depth.

Figure 5B:
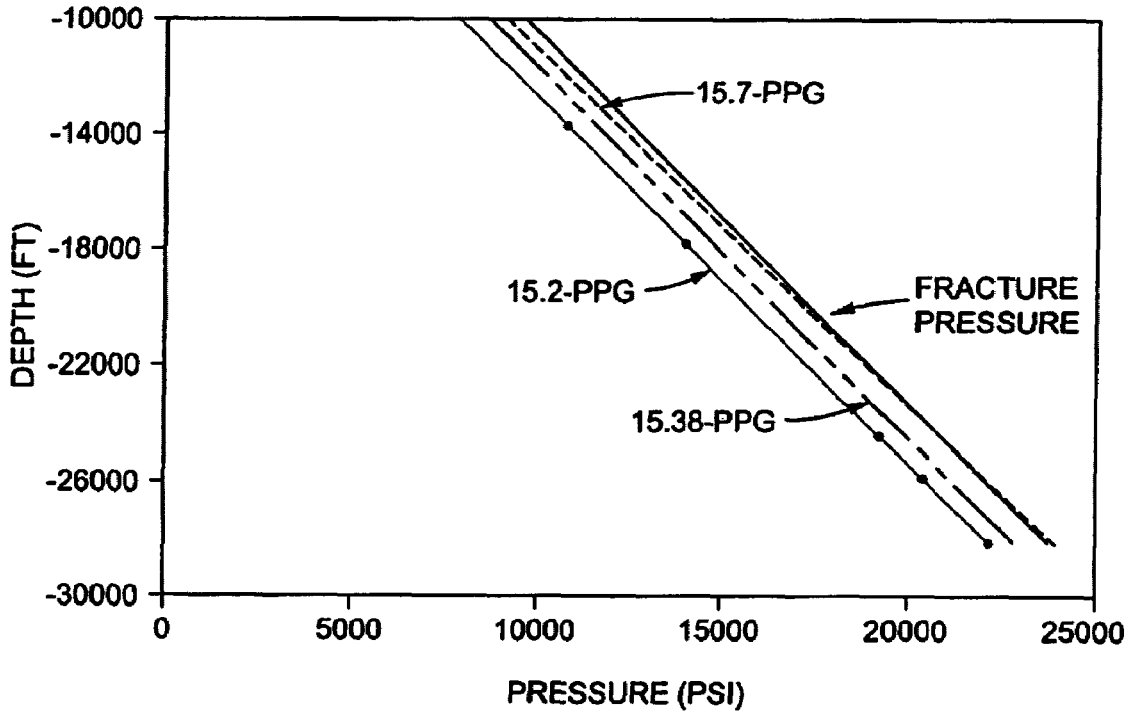

FIG. 5B is the effect of ECD reduction tool on pressure safety margin for formation fracturing with heavyweight drilling fluid in a circulating ERD well.

DETAILED DESCRIPTION OF THE PREFERRED EMBODIMENT

The present invention relates to apparatus and methods to reduce the pressure of a circulating fluid in a wellbore. The invention will be described in relation to a number of embodiments and is not limited to any one embodiment shown or described.

FIG. 1 is a section view of a wellbore 105 including a central and a horizontal portion. The central wellbore is lined with casing 110 and an annular area between the casing and the earth is filled with cement 115 to strengthen and isolate the wellbore 105 from the surrounding earth. At a lower end of the central wellbore, the casing terminates and the horizontal portion of the wellbore is an "open hole" portion. Coaxially disposed in the wellbore is a work string 120 made up of tubulars with a drill bit 125 at a lower end thereof. The bit rotates at the end of the string 120 to form the borehole and rotation is either provided at the surface of the well or by a mud motor (not shown) located in the string 120 proximate the drill bit 125. In FIG. 1, an annular area around the upper portion of the work string is sealed with a packer 130 disposed between the work string and a wellhead 135.

As illustrated with arrows 140, drilling fluid or "mud" is circulated down the work string and exits the drill bit 125. The fluid typically provides lubrication for the rotating bit, means of transport for cuttings to the surface of the well, and as stated herein, a force against the sides of the wellbore to keep the well in control and prevent wellbore fluids from entering the wellbore before the well is completed. Also illustrated with arrows 145 is the return path of the fluid from the bottom of the wellbore to the surface of the well via an annular area 150 formed between the work string 120 and the walls of the wellbore 105.

Disposed on the work string and shown schematically in FIG. 1 is an ECD reduction tool including a motor 200 and a pump 300. The purpose of the motor 200 is to convert fluid pressure into mechanical energy and the purpose of the pump 300 is to act upon circulating fluid in the annulus 150 and provide energy or lift to the fluid in order to reduce the pressure of the fluid in the wellbore 105 below the pump. As shown, and as will be discussed in detail below, fluid traveling down the work string 120 travels through the motor and causes a shaft therein (not shown) to rotate as shown with arrows 205. The rotating shaft is mechanically connected to and rotates a pump shaft (not shown). Fluid flowing upwards in the annulus 150 is directed into an area of the pump (arrows 305) where it flows between a rotating rotor and a stationary stator. In this manner, the pressure of the circulating fluid is reduced in the wellbore below the pump 300 as energy is added to the upwardly moving fluid by the pump.

Fluid or mud motors are well known in the art and utilize a flow of fluid to produce a rotational movement. Fluid motors can include progressive cavity pumps using concepts and mechanisms taught by Moineau in U.S. Pat. No. 1,892,217, which is incorporated by reference herein in its entirety. A typical motor of this type has two helical gear members wherein an inner gear member rotates within an outer gear member. Typically, the outer gear member has one helical thread more than the inner gear member. During the rotation of the inner gear member, fluid is moved in the direction of travel of the threads. In another variation of motor, fluid entering the motor is directed via a jet onto bucket-shaped members formed on a rotor. Such a motor is described in International Patent Application No. PCT/GB99/02450 and that publication is incorporated herein in its entirety. Regardless of the motor design, the purpose is to provide rotational force to the pump therebelow so that the pump will affect fluid traveling upwards in the annulus.

FIG. 2A is a section view of the upper portion of one embodiment of the motor 200. FIG. 2B is a section view of the lower portion thereof. Visible in FIG. 2A is the wellbore casing 110 and the work string 120 terminating into an upper portion of a housing 210 of the motor 200. In the embodiment shown, an intermediate collar 215 joins the work string 120 to the motor housing 210. Centrally disposed in the motor housing is a plug assembly 255 that is removable in case access is needed to a central bore of the motor housing. Plug 255 is anchored in the housing with three separate sets of shear pins 260, 265, 270 and a fish-neck shape 275 formed at an upper end of the plug 255 provides a means of remotely grasping the plug and pulling it upwards with enough force to cause the shear pins to fail. When the plug is in place, an annulus is formed between the plug and the motor housing (210) and fluid from the work string travels in the annulus. Arrows 280 show the downward direction of the fluid into the motor while other arrows 285 show the return fluid in the wellbore annulus 150 between the casing 110 and the motor 200.

The motor of FIGS. 2A and 2B is intended to be of the type disclosed in the aforementioned international application PCT/GB99/02450 with the fluid directed inwards with nozzles to contact bucket-shaped members and cause the rotor portion of shaft to turn.

A shaft 285 of the motor 200 is suspended in the housing 210 by two sets of bearings 203, 204 that keep the shaft centralized in the housing and reduce friction between the spinning shaft and the housing therearound. At a location above the lower bearings 204, the fluid is directed inwards to the central bore of the shaft with inwardly directed channels 206 radially spaced around the shaft. At a lower end, the shaft of the motor is mechanically connected to a pump shaft 310 coaxially located therebelow. The connection in one embodiment is a hexagonal, spine-like connection 286 rotationally fixing the shafts 285, 310, but permitting some axial movement within the connection. The motor housing 210 is provided with a box connection at the lower end and threadingly attached to an upper end of a pump housing 320 having a pin connection formed thereupon.

While the motor in the embodiment shown is a separate component with a housing threaded to the work string, it will be understood that by miniaturizing the parts of the motor, it could be fully disposed within the work string and removable and interchangeable without pulling the entire work string from the wellbore. For example, in one embodiment, the motor is run separately into the work string on wire line where it latches at a predetermined location into a preformed seat in the tubular work string and into contact with a pump disposed therebelow in the work string.

FIG. 2C is a section view of the pump 300 and FIG. 2D is a section view of a portion of the wellbore below the pump. FIG. 2C shows the pump shaft 310 and two bearings 311, 312 mounted at upper and lower end thereof to center the pump shaft within the pump housing. Visible in FIG. 2C is an impeller section 325 of the pump 300. The impeller section includes outwardly formed undulations 330 formed on an outer surface of a rotor portion 335 of the pump shaft and matching, inwardly formed undulations 340 on the interior of a stator portion 345 of the pump housing 320 therearound.

Below the impeller section 325 is an annular path 350 formed within the pump for fluid traveling upwards towards the surface of the well. Referring to both FIGS. 2C and 2D, the return fluid travels into the pump 300 from the annulus 150 formed between the casing 110 and the work string 120. As the fluid approaches the pump, it is directed inwards through inwardly formed channels 355 where it travels upwards and through the space formed between the rotor and stator (FIG. 2C) where energy or upward lift is added to the fluid in order to reduce pressure in the wellbore therebelow. As shown in the figure, return fluid traveling through the pump travels outwards and then inwards in the fluid path along the undulating formations of the rotor or stator.

FIG. 3 is a partial perspective view of a portion of the impeller section 325 of the pump 300. In a preferred embodiment, the pump is a turbine pump. Fluid, shown by arrows 360, travels outwards and then inwards along the outwardly extending undulations 330 of the pump rotor 335 and the inwardly formed undulations 340 of the stator 345. In order to add energy to the fluid, the upward facing portion of each undulation 330 includes helical blades 365 formed thereupon. As the rotor rotates in a clock-wise direction as shown by arrows 370, the fluid is acted upon by a set of blades 365 as it travels inwards towards the central portion of the rotor 335. Thereafter, the fluid travels along the outwardly facing portion of the undulations 330 to be acted upon by the next set of blades 365 as it travels inward.

FIG. 4 is a section view of a wellbore showing an alternative embodiment of the invention. A jet device 400 utilizing nozzles to create a low-pressure area is disposable in the work string (not shown). The device serves to urge fluid in the wellbore annulus upwards, thereby adding energy to the fluid. More specifically, the device 400 includes a restriction 405 in a bore thereof that serves to cause a backpressure of fluid traveling downwards in the wellbore (arrows 410). The backpressure causes a portion of the fluid (arrows 420) to travel through openings 425 in a wall 430 of the device and to be directed through nozzles 435 leading into annulus 150. The remainder of the fluid continues downwards (arrows 440). The nozzle includes an orifice 455 and a diffuser portion 465. The geometry and design of the nozzle creates a low-pressure area 475 near and around the end of each nozzle 435. Because of fluid communication between the low-pressure area 475 and the wellbore annulus 150, fluid below the nozzle is urged upwards due to the pressure differential.

In the embodiment of FIG. 4, the annular area 150 between the jet device and the wellbore casing 110 is sealed with a pair of packers 480, 485 to urge the fluid into the jet device. The restriction 405 of the assembly is removable to permit access to the central bore below the jet device 400. To permit installation and removal of the restriction 405, the restriction is equipped with an outwardly biased ring 462 disposable in a profile 463 formed in the interior of the jet device. A seal 464 provides sealing engagement with the jet device housing.

In use, the jet device 400 is run into a wellbore in a work string. Thereafter, as fluid is circulated down the work string and upwards in the annulus, a back pressure caused by the restriction causes a portion of the downwardly flowing fluid to be directed into channels and through nozzles. As a low-pressure area is created adjacent each nozzle, energy is added to fluid in the annulus and pressure of fluid in the annulus below the assembly is reduced.

The following are examples of the invention in use which illustrate some of the aspects of the invention in specific detail.

The invention provides means to use viscous drilling fluid to improve cuttings transport. Cuttings move with the flowing fluid due to transfer of momentum from fluid to cuttings in the form of viscous drag. Acceleration of a particle in the flow stream in a vertical column is given be the following equation.

$$m\frac{du_p}{dt} = \frac{1}{2}C_d\rho_f a(u_f - u_p)|u_f - u_p| - mg\left(1 - \frac{\rho_f}{\rho_p}\right) \quad (1)$$

Where, m=mass of the particle $u_p$=instantaneous velocity of the particle in y direction $C_d$=drag coefficient $\rho_f$=fluid density a=projected area of the particle $u_f$=Fluid velocity in y direction ρp=particle density, and g=acceleration due to gravity.

The coefficient of drag is a function of dimensionless parameter called Reynolds number ($R_e$). In a turbulent flow, it is given as $$C_d = A + \frac{B}{R_e} + \frac{C}{R_e^2} \text{ and} \quad (2)$$

$$R_e = \frac{\rho_f d}{\mu}|u_f - u_p| \quad (3)$$

where d=particle diameter

μ=fluid viscosity

A, B, C are constants.

As mentioned earlier, potential benefits of using the methods and apparatus described here are illustrated with the example of a Gulf of Mexico deep well having a target depth of 28,000-ft.

As stated in a previous example, casing program for the GOM well called for seven casing sizes, excluding the surface casing, starting with 20" OD casing and ending with 5" OD casing (Table 1). The 9⅝" OD casing shoe was set at 18,171-ft MD (17,696 MD) with 15.7-ppg leakoff test. Friction head at 9⅝" casing shoe was calculated as 326-psi, which gave an ECD of 15.55-ppg. Thus with 15.55-ppg ECD the margin for kickoff was 0.15-ppg.

From the above information, formation fracture pressure ($P_{f9.625}$), hydrostatic head of 15.2-ppg drilling fluid ($P_{h9.625}$) and circulating fluid pressure ($P_{ECD9.625}$) at 9⅝" casing shoe can be calculated as:

$$P_{f9.625}=0.052\times15.7\times17{,}696=14{,}447 \text{ psi}$$

$$P_{h9.625}=0.052\times15.2\times17{,}696=13{,}987 \text{ psi}$$

$$P_{ECD9.625}=0.052\times15.55\times17{,}696=14{,}309 \text{ psi.}$$

Average friction head per foot of well depth=322/18,171=1.772×10−2 psi/ft.

Theoretically the ECD reduction tool located in the drill string above the 9⅝" casing shoe could provide up to 322-psi pressure boost in the annulus to overcome the effect of friction head on wellbore pressure. However, for ECD motor and pump to operate effectively, drilling fluid flow rate has to reach 40 to 50 percent of full circulation rate before a positive effect on wellbore pressure is realized. Hence, the efficiency of the ECD reduction tool is assumed to be 50%, which means that the circulating pressure at 9⅝" casing shoe with an ECD reduction tool in the drill string would be 14,148-psi (14,309−326/2).

$$\text{Actual } ECD = 14{,}148/(0.052 \times 17{,}696) = 15.38 \text{ ppg.}$$

Evidently the safety margin for formation fracturing improved to 0.32-ppg from 0.15-ppg. Assuming the fracture pressure follows the same gradient (15.7-ppg) all the way up to 28,000-ft TVD, the fracture pressure at TVD is:

$$P_{fTVD} = 0.052 \times 15.7 \times 28{,}000 = 22{,}859\text{-psi.}$$

Circulating pressure at 28,000 TVD=0.052×15.38×28,000+1.772×10$^{-2}$×(28000−17696)=22,576 psi The above calculations are summarized in Table 2 for different depths in the well where 7-inch and 5-inch casing shoes were to be set as per Table 1.

TABLE 2

Summary of pressure calculations at different depths in the well.

| Vertical depth, ft | Measured depth, ft | Frac Pressure | Hydrostatic head of 15.2-ppg drilling fluid | Wellbore Pressure Without ECD tool | Wellbore pressure With ECD tool | Casing Size, in. |
|---|---|---|---|---|---|---|
| 17,696 | 18,171 | 14,447 | 13,987 | 14,309 | 14,153 | 9⅝ |
| 24,319 | 25,149 | 19,854 | 19,222 | 19,782 | 19,56 7 | 7 |
| 25,772 | 26,750 | 21,040 | 20,370 | 20,982 | 20,755 | 7 |
| 28,000 | | 22,859 | 22,131 | 22,823 | 22,576 | 7 |

FIG. 5B is a representation of results given in Table 2. Notice the trend of 15.55-ppg curve with respect to the formation fracture pressure curve. The pressure gradient of 15.55-ppg drilling fluid runs very close to the fracture pressure gradient curve below 9⅝" casing shoe depth leaving very little safety margin. In comparison, the pressure gradient of the same drilling fluid with an ECD reduction tool in the drill string (15.38-ppg ECD) runs well within hydrostatic gradient and fracture pressure gradient. This analysis shows that the entire segment of the well below ⅝" casing could be drilled with 15.2-ppg drilling fluid if there was an ECD reduction tool in the drill string. A 7" casing could be set at TVD eliminating the need for 5" casing.

From equation 3 it is evident that Reynolds number is inversely proportional to the fluid viscosity. Everything being equal, higher viscosity gives lower Reynolds number and corresponding higher coefficient of drag. Higher coefficient of drag causes particles to accelerate faster in the fluid stream until particles attain the same velocity as that of the fluid [$(u_f - u_p)=0$]. Clearly fluid with higher viscosity has a greater capacity to transport cuttings. However, in drilling operations, using viscous fluid causes friction head to be higher thereby increasing ECD. Thus without an ECD reduction tool, using a high viscosity drilling fluid may not be possible under some conditions.

While the invention has been described in use in a wellbore, it will be understood that the invention can be used in any environment where fluid circulates in a tubular member. For example, the invention can also be used in an offshore setting where the motor and pump are disposed in a riser extending from a platform at the surface of the ocean to a wellhead below the surface of the ocean.

While the foregoing is directed to embodiments of the present invention, other and further embodiments of the invention may be devised without departing from the basic scope thereof, and the scope thereof is determined by the claims that follow.

For example, the apparatus may consist of a hydraulic motor, electric motor or any other form of power source to drive an axial flow pump located in the wellbore for the purpose of reducing and controlling fluid pressure in the annulus and in the downhole region. In other instances, pressurized fluid pumped from the surface might be used to run one or more jet pumps situated in the annulus for controlling and reducing return fluid pressure in the annulus and downhole pressure in the well.

The invention claimed is:

1. A method of compensating for a friction head developed by a circulating fluid in a wellbore, the method comprising:

adding energy to the fluid traveling in an annulus defined between a work string and the wellbore, wherein adding energy reduces the friction head in the wellbore; and urging at least a portion of the fluid traveling through a bore of the work string through a jet assembly having at least one nozzle leading into the annulus.

2. The method of claim 1, whereby the adding energy to the fluid reduces a pressure of the fluid in the wellbore.

3. A method of removing cuttings from a wellbore during drilling, the method comprising:

circulating a fluid down a work string and upwards in an annular area of the wellbore;

adding energy to the fluid in the annular area; and urging at least a portion of the fluid circulating down the work string through a jet assembly having at least one nozzle leading into the annular area.

4. The method of claim 3, whereby the adding energy to the fluid is by a pump having a rotor and a stator portion, the rotor portion rotated by the fluid in the work string.

5. A method of using a drilling fluid with a relatively high density in a circulating wellbore comprising:

providing a tubular string within a wellbore, wherein an annulus is defined between the tubular string and the wellbore;

providing the drilling fluid with a predetermined density through a bore of the tubular string; and providing energy to the fluid at a point in the wellbore where the fluid is traveling to a surface of the wellbore, thereby reducing a pressure of the fluid and compensating for the relatively high density, wherein providing energy to the fluid comprises urging at least a portion of the fluid traveling through the bore of the tubular string through a jet assembly having at least one nozzle leading into the annulus.

6. An apparatus for use in a wellbore, comprising:

a body disposed in a tubular string, the body defining a central bore therein and an annular area therearound; and a jet assembly having at least one nozzle leading into the annular area and directed toward a surface of the wellbore.

7. The apparatus of claim 6, further comprising a restriction positioned within the central bore for urging at least a portion of a circulating fluid through the at least one nozzle.

8. The apparatus of claim 6, further comprising a removable restriction positioned within the central bore for urging at least a portion of a circulating fluid through the at least one nozzle.

9. The apparatus of claim 6, further comprising at least one packer circumscribing the jet assembly and disposed in the annular area.

10. A method of effacing a circulation of a fluid in a wellbore, comprising:

circulating the fluid through the wellbore, wherein the fluid travels through a tubular in a first direction and travels through an annular area around the tubular in a second direction; and urging at least a portion of the fluid in the tubular through a jet assembly having at least one nozzle leading Into the annular area and directed in the second direction.

11. A method of using a drilling fluid with a relatively high viscosity comprising:

drilling a bore having at least one central portion and at least one horizontal portion;

circulating the fluid having a predetermined viscosity through a tubular string extending through the bore, whereby an annulus is formed between the tubular string and the bore, and the fluid passes through a lower end of the string and through the annulus; and adding energy to the fluid in the annulus above the at least one horizontal portion of the bore, thereby reducing fluid pressure and compensating for the relatively high viscosity of the fluid.

* * * * *